US011905568B2

(12) United States Patent
Molina Mesa

(10) Patent No.: US 11,905,568 B2
(45) Date of Patent: Feb. 20, 2024

(54) SYSTEMS AND METHODS FOR DEFORMATION COMPENSATION

(71) Applicant: AUTOTECH ENGINEERING S.L., Amorebieta-Etxano (ES)

(72) Inventor: Ricardo Molina Mesa, Sant Esteve Sesrovires (ES)

(73) Assignee: AUTOTECH ENGINEERING S.L., Amorebieta-Etxano (ES)

( * ) Notice: Subject to any disclaimer, the term of this patent is extended or adjusted under 35 U.S.C. 154(b) by 0 days.

(21) Appl. No.: 17/923,906

(22) PCT Filed: May 7, 2021

(86) PCT No.: PCT/EP2021/062124
§ 371 (c)(1),
(2) Date: Nov. 7, 2022

(87) PCT Pub. No.: WO2021/224452
PCT Pub. Date: Nov. 11, 2021

(65) Prior Publication Data

US 2023/0117515 A1 Apr. 20, 2023

(30) Foreign Application Priority Data

May 8, 2020 (EP) ..... 20382377

(51) Int. Cl.
*C21D 8/02* (2006.01)
*C21D 9/00* (2006.01)

(52) U.S. Cl.
CPC ..... *C21D 8/0294* (2013.01); *C21D 8/0205* (2013.01); *C21D 9/0068* (2013.01)

(58) Field of Classification Search
CPC ..... B21D 1/14; B21D 53/88; C21D 8/0205; C21D 8/0294; C21D 9/0068; C21D 9/46
(Continued)

(56) References Cited

U.S. PATENT DOCUMENTS 4,592,537 A * 6/1986 Pfaffmann ..... C21D 1/00 266/90
5,587,633 A * 12/1996 Aoki ..... B30B 15/14 318/164

(Continued)

FOREIGN PATENT DOCUMENTS

JP H09314399 * 12/1997 ..... B21D 22/22
JP 2004-091894 A 3/2004

(Continued)

OTHER PUBLICATIONS

International Search Report dated Jul. 6, 2021 for International Application No. PCT/EP2021/062124, pages.

(Continued)

*Primary Examiner* — Scott R Kastler
*Assistant Examiner* — Michael Aboagye
(74) *Attorney, Agent, or Firm* — Squire Patton Boggs (US) LLP

(57) ABSTRACT

A system configured for deformation compensation in real time during a heat treatment performed on a component. The system comprises a supporting structure; two or more clamping devices arranged with the supporting structure, one or more clamping devices including a clamp, a load cell and a motor; and a processing and control system configured to collect signals from a load cell and to send signals based on the detected loads to a motor to compensate for deformation due to the heat treatment.

8 Claims, 4 Drawing Sheets

(58) Field of Classification Search
USPC ..... 266/117, 241
See application file for complete search history.

(56) References Cited

U.S. PATENT DOCUMENTS

| | | | | | |
|---|---|---|---|---|---|
| 5,806,402 | A * | 9/1998 | Henry | F15B 15/14 92/136 |
| 8,034,285 | B2 * | 10/2011 | Canner | C21D 11/00 266/259 |
| 9,849,639 | B2 * | 12/2017 | Hirano | B29C 71/0063 |
| 2012/0103477 | A1 * | 5/2012 | Branagan | C22C 45/02 148/540 |

FOREIGN PATENT DOCUMENTS

| | | | | |
|---|---|---|---|---|
| JP | 2004106035 | A | 4/2004 | |
| JP | 2013237062 | * | 11/2013 | B21D 22/22 |
| JP | 2015090224 | * | 5/2015 | C21D 9/0075 |
| JP | 2015090224 | A | 5/2015 | |
| KR | 102014911 | B1 | 8/2019 | |
| KR | 102052172 | * | 12/2019 | B21D 22/22 |
| KR | 102052172 | B1 | 12/2019 | |
| KR | 102052174 | B1 | 12/2019 | |
| WO | WO 2008/109073 | A1 | 9/2008 | |
| WO | WO 2016/190608 | A1 | 12/2016 | |

OTHER PUBLICATIONS

Written Opinion and Written Opinion dated Jul. 6, 2021 for International Application No. PCT/EP2021/062124, 11 pages.

Notification of Reasons for Refusal dated May 16, 2023 for Japanese Patent Application No. 2022-567581; with English translation, 8 pages.

Notice of Reasons for Refusal dated May 16, 2023 issued for Japanese Patent Application No. 2022-567581, with English translation; 10 pages.

* cited by examiner

400

SYSTEMS AND METHODS FOR DEFORMATION COMPENSATION

CROSS-REFERENCE

The present application is a National Stage filing under 35 U.S.C. § 371 of International Patent Application No. PCT/EP2021/062124, filed May 7, 2021, which claims the benefit of and priority to European Patent Application No. 20382377.81, filed on May 8, 2020, the contents of all of which are hereby incorporated by reference in their entireties for all purposes.

FIELD

The present disclosure relates to systems configured for compensating deformation in a component, particularly a component for a vehicle framework, occurring during a heat treatment. The present disclosure further relates to methods for deformation compensation during a heat treatment performed on such a component.

BACKGROUND

Vehicles such as automobiles include structural skeletons designed to withstand all loads the vehicle can receive during its lifetime. The structural framework is further designed to withstand and absorb impacts, for example, in the event of a collision with another vehicle or obstacle.

In this sense, for example, the structural framework of a vehicle that is an automobile may include bumpers, pillars (A-pillar, B-pillar, C-pillar), side impact beams, rocker panels and shock absorbers. It has become common to use so-called Ultra-High Strength Steels (UHSS), which exhibit optimized maximum strength per weight unit and advantageous forming properties in the automotive industry, for the structural framework of the vehicle or at least a number of its components. The UHSS may have a maximum tensile strength of at least 1000 MPa, preferably up to about 1500 MPa or up to 2000 MPa or more.

An example of steel used in the automotive industry is 22MnB5 steel.

Processing a component for a vehicle may comprise forming of a metal plate, in particular a steel plate in order to give the plate a desired shape. In general, forming can cause the accumulation of stresses in the regions of the component which have been bent or otherwise deformed.

One process that is used particularly in the automotive industry is Hot Forming Die Quenching (HFDQ). In the HFDQ process, a steel blank is heated to above austenization temperature, above Ac1 or above Ac3. After heating to above the austenization temperature, the blanks are placed in a hot forming press. The blanks are deformed and at the same time are quenched (rapidly cooled down). Cooling down may typically occur at a rate that is higher than a so-called critical cooling rate. The critical cooling rate for steels in HFDQ may be around 27° C./s. As a result of the quenching, the deformed blank may obtain a martensitic microstructure. Depending on the exact temperature and the heating time, a fully martensitic microstructure can be obtained. The resulting product in this manner can obtain a high hardness, and corresponding high ultimate tensile strength, and high yield strength. On the other hand, maximum elongation (elongation at break) may be relatively low.

Once the component for a vehicle has a desired shape, the component may undergo post processing. Post processing may include riveting, punching, calibrating, trimming and many others.

A typical post processing operation includes heating a portion of the component to tailor and enhance the properties of the component. For example, creating a "soft zone" or "softzone", e.g. by laser, provides for increased ductility to the treated region of the component. The martensitic microstructure may be changed to a more ferritic, pearlitic and/or bainitic microstructure by heating the area of the component and subsequent cooling, typically relatively slow cooling. As a result, the hardness of the heat treated zone or area of the component may be reduced, resulting in a more ductile material. I.e. the area may have a higher elongation at break. At the same time, yield strength and ultimate tensile strength may be lower than for the martensitic microstructure.

When performing such a heat treatment to a component, residual tensions accumulated during a previous forming process are released and the component may thus be deformed. For instance, if a soft zone is being created in an area of a hot formed component, this may distort several regions of the hot formed component.

Therefore, as used herein, "forming" is to be understood as any metalworking process performed on a component for a vehicle, including fashioning metal parts and objects through mechanical deformation; the workpiece is reshaped without adding or removing material, and its mass remains unchanged. Forming may include particularly die forming, rolling, bending, and may cover any of such processes that causes the accumulation of stresses in the component.

Also, as used herein, "heat treatment" is to be understood as any heating process performed on a component for a vehicle which, due to the heat applied to the component, can release stresses accumulated in the component in a previous process performed to the component (i.e. "forming") and can deform the component due to the stresses released.

This problem is already known in the art. A possible way to deal with this issue is by adapting the forming process (e.g. HFDQ process) to provide a component that does not have the final desired dimensions. That is to say, one may create e.g. a softzone on a component, observe the deformation occurring to the component due to the heating process and then adapt the HFDQ process for subsequent component to compensate for the expected deformation due to the subsequent softzone process. Hence, if this adjustment could be performed correctly, a component with the exact desired geometry and dimensions will be the result.

However, this method is not very accurate and does not take into account the individualities of each component. No two components are exactly the same. Inevitably, different blanks will not have an exactly constant thickness over their entire length and width. Also the blanks will not be cut to exactly the same geometry and there may very slight variations in steel compositions from one blank to the next. This is due to the inevitable variation and tolerances in industrial processes.

Each component is thus in reality unique in that e.g. the stresses accumulated in the component depend on several factors, such as the thickness and the microstructure of the component. The previous process undergone by each component, e.g. forming, therefore causes different residual stresses to each component depending on the particularities of each component.

Thus, the present disclosure aims to provide methods and systems that avoid or at least reduce some of the aforementioned problems.

SUMMARY

In a first aspect, a system for compensating deformation in real time during a heat treatment performed on a component is provided. The system comprises a support and one or more clamping devices arranged with the support. The clamping devices comprise a clamp configured to clamp the component, a motor to drive the clamp; and a load cell connected to the clamp, and configured to detect loads due to the heat treatment performed on the component. The system further comprises a processing and control system configured to collect signals from the load cell of the clamping devices and to send signals based on the detected loads to the motor of the clamping devices to compensate for deformation due to the heat treatment.

The processing and control system is configured to collect signals from a load cell and to send signals based on the detected loads to a (servo) motor to compensate deformation due to the heat treatment.

This system enables compensating the deformation in the component caused by the application of a heat treatment to the component that releases residual stresses accumulated in the component due to previous forming of the component. This is done in real time and takes the individualities of each component into account.

Using a load cell as a sensor, and therefore detecting forces being applied to the component, allows for direct measurements of the effect that the release of stresses has on the component. In addition, the load cell is able to detect even relatively small forces applied to the component. Thus, the system allows for an accurate compensation of deformation in a wide range of applied forces. In some examples, also motor consumption (e.g. current levels) when the motor is driving one of the clamps may be measured and taken into account. The motor consumption to move a clamp can indicate a resistance that is noticed by a motor when moving a clamp and submitting the component to a deformation. These measurements may therefore be indicative of how the component is deforming, while undergoing a heat treatment.

In some examples, one or more clamping devices further comprise a linear encoder connected to the clamp, wherein the linear encoder is configured to measure the position of the clamp and the processing and control system is further configured to collect signals from the linear encoder.

This configuration enables to know the absolute position of the clamp independently from the precision of the servo motor. The position of the clamp may be obtained from the motor (e.g. through an encoder, or resolver), but if there are intermediate components between the (servo) motor and the clamp, the position given by the (servo) motor might not be as accurate as required or desired. Thus, the use of a linear encoder connected to the clamp makes it possible to have a more accurate position of the clamp.

In some examples, a motor may be operatively connected with the clamp through a linear drive mechanism, e.g. involving a spindle. In these cases, the clamp may be moved along a single direction, e.g. substantially vertically. In some examples, the motor with drive mechanism may be rotatably mounted, e.g. a motor may be mounted in a socket. The motor may then assume a suitable position in the socket, such that the direction of movement of the clamp may be fixed in a suitable manner. In different examples of the present disclosure, the clamps may be driven substantially horizontally, substantially vertically, diagonally, or combinations thereof.

In some examples, the motor may be operatively connected with the clamp with a more complex drive mechanism with more than one degree of freedom. E.g. the operative connection may include several different actuators. In this case, instead of rotating or reorienting the motor, the drive mechanism can make the adjustments to drive a clamp in a desired direction.

In a second aspect, a method for deformation compensation in real time during a heat treatment performed on a component is provided. The method comprises providing a component and a system according to any of the examples disclosure herein. The method further comprises clamping the component by the one or more clamping devices; performing a heat treatment on the component; and measuring one or more loads by one of the load cells connected to one of the clamps. Then, a clamp can be moved as a function of the measured loads.

This method compensates in real time for deformation occurring to the component during the heat treatment. In addition, the compensation is adaptive, in the sense that the particularities of each component, as commented above, are taken into account.

Using one clamping device or more than one clamping device makes it possible to tailor the compensation to the requirements of compensation in a specific component and/or in a specific heat treatment. For instance, depending on the component being subjected to the heat treatment, e.g. material, size and/or thickness, and the extension and location of the heat procedure being applied on the component, a certain number of clamping devices positioned in certain locations of the supporting structure and clamped in certain regions of the component will be preferable.

Suitable numbers and positions of the clamping devices in the supporting structure and in the region of the component clamped by the corresponding clamps may be selected according to computational simulations, or based on trial-and-error. Also, the direction(s) of movement of the clamp, or multiple clamps may be adjusted as needed.

The concept is also applicable to other situations wherein a component is being deformed and real-time compensation of the deformation is desired. For instance, if a component or a tool is modified and this causes deformation in other parts of the component or tool, this disclosure and proposed solution also apply.

BRIEF DESCRIPTION OF THE DRAWINGS

Non-limiting examples of the present disclosure will be described in the following, with reference to the appended figures, in which.

The figures also refer to example implementations and are only be used as an aid for understanding the claimed subject matter, not for limiting it in any sense.

DETAILED DESCRIPTION OF EXAMPLES

Figure 1:
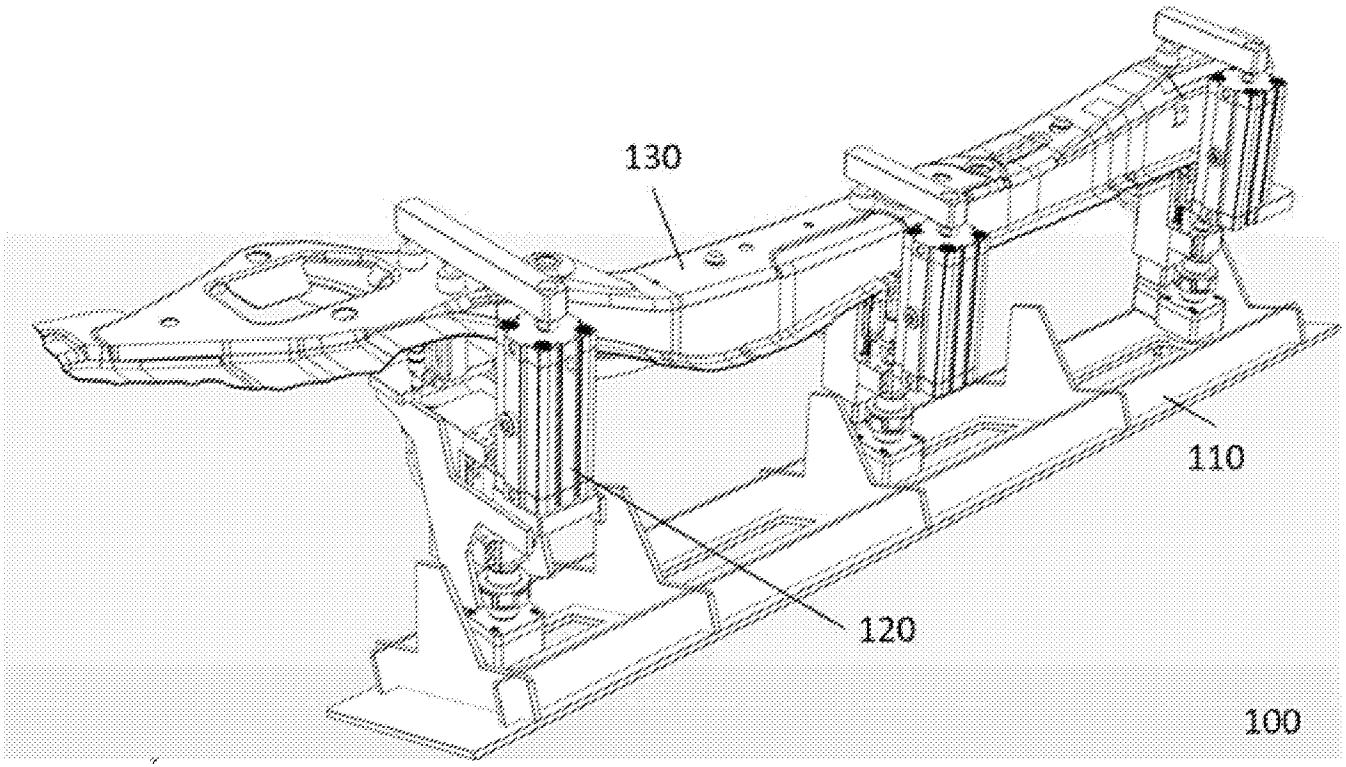
FIG. 1 shows a system configured for deformation compensation in real time during a heat treatment performed on a component for a vehicle according to an example.

FIG. 1 illustrates an example of a system 100 configured for compensating deformation in real time during a heat treatment performed on a component 130 for a vehicle.

Figure 3:
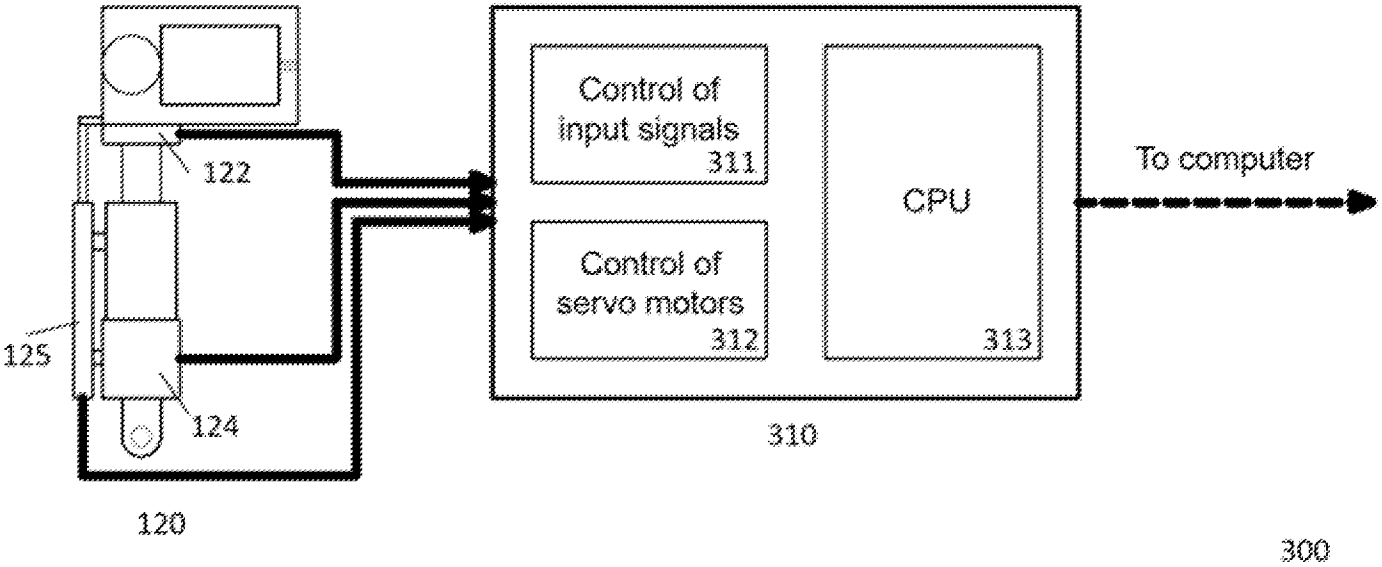
FIG. 3 schematically illustrates some connections between a clamping device and a processing and control system according to an example.

The system 100 comprises a supporting structure 110, one or more clamping devices 120 supported by the supporting structure 110 and a processing and control system (310, schematically shown in FIG. 3).

The supporting structure 110 may be any type of structure or fixture which serves for supporting or carrying the one or more clamping devices 120. The size and geometry of the structure may be adapted to the component that undergoes the heat treatment. Suitable components for a vehicle framework include e.g. a B-pillar, A-pillar, bumper, a rocker, front and rear rails etc.

For instance, as shown in FIG. 1, in one example the supporting structure 110 may comprise a grid structure including two longitudinal bars substantially parallel to each other and five transversal bars substantially parallel among them and substantially perpendicular to the longitudinal bars. This grid may be positioned on a substantially rectangular base with substantially rectangular openings as illustrated in FIG. 1. One or more transversal bars may have a protrusion extending upwardly to which a supporting substructure for the clamping device 120 may be mounted to.

It shall be understood that the shape, type and/or number of the elements described in the paragraph above are merely illustrative, and that other shapes, types and/or number of elements may be used. In some examples, the base and the bars may be a single component. In some other examples, a longitudinal bar may include more than one bar which is shorter than the longitudinal bar. In some other examples, the supporting structure 110 may comprise one or more substantially rectangular frames, two or more frames being attached between them if there are at least two frames. These configurations and other configurations can be in combined among them as desired.

This type of supporting structure 110 allows arranging a desired number of clamping devices 120 in desired positions along the component 130 to be clamped according to e.g. the heat treatment to be performed on the component 130 and/or the region of the component 130 where the heat treatment is to be applied. Thus, the compensation of deformation can be optimized for the component 130 and the post processing heat treatment.

In some examples, a clamping device 120 may substantially be located in the middle of the supporting structure 110. In some other examples, a clamping device 120 may be located at or near an end of the supporting structure 110. In general, any number of clamping devices 120 may be located wherever in the supporting structure 110. This way, the clamping device(s) 120 enable to compensate the deformation of the component 130 during a heat treatment where necessary in the component 130, be it in a portion of the component 130 or along the whole component 130.

Figure 2:
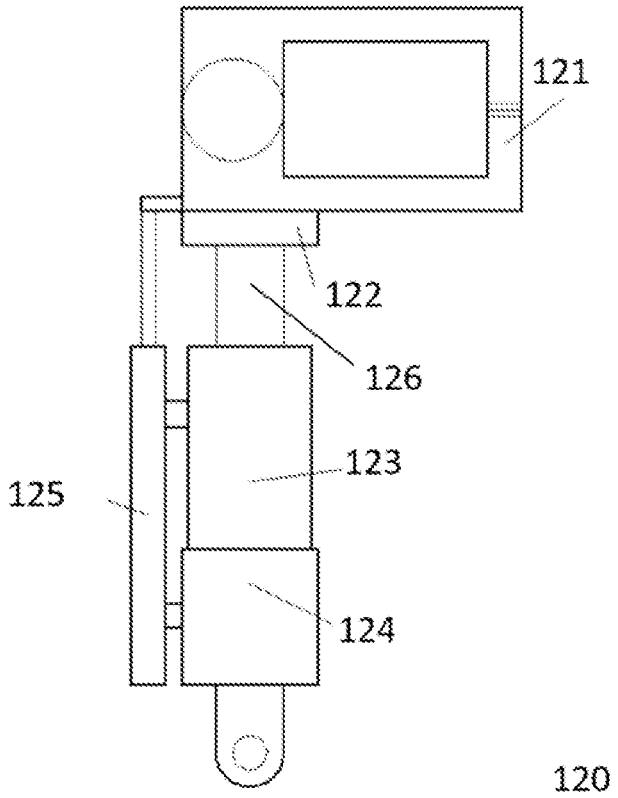
FIG. 2 schematically represents a clamping device according to an example.

FIG. 2 schematically represents a clamping device 120 according to an example. The clamping device 120 comprises a clamp 121, a load cell 122 and a motor 124, e.g. a servomotor or stepper motor. The clamp 121 is configured to clamp a portion of component 130, the load cell 122 is configured to detect loads, which can result due to the heat treatment performed on the component 130, and the clamp 121 is vertically movable by the motor 124.

The load cell 122 may be connected to the clamp 121. The clamp 121 may be a pneumatic clamp. In this example, the load cell 122 is below the clamp 121. In other examples, the load cell 122 may be located in a different position, e.g. above the clamp 121. The position of the load cell 122 is such that it enables the load cell 122 to measure the force that is performed on the component 130 due to the release of stresses accumulated in a component 130 caused by a heat treatment on the component 130. Herein, the term "force" shall be understood to include e.g. force, weight, load, tension, compression, pressure, torque or any suitable magnitude that a person skilled in the art may understand that is measured by a load cell 122.

The value measured by the load cell 122 may be an absolute value or a relative value, e.g. with respect to a fixed reference or a previous measured value.

The load cell 122 may withstand tension loads and/or compression loads.

The motor 124 is operatively connected to the clamp 121. In FIG. 2, the motor 124 and the clamp 121 are operatively connected with a linear drive mechanism. Specifically in this example, the motor is connected through a spindle 123 which is attached to the motor 124. In this example, a load cell 122 is positioned at the end of the shaft 126 of spindle 123. Thus, in order to compensate the deformation caused to the component 130, the servo motor 124 may act on the spindle 123, and the shaft may move in or out of the spindle housing, and thereby move the clamp upwards or downwards. In this particular example, all clamps are arranged to be driven substantially vertically, but in other examples, the clamps and motors may be arranged to drive the clamps in other linear directions, or along more complicated trajectories.

In some examples, a motor body may be rotatably or pivotably mounted such that it can adjust the direction along which the corresponding clamp may be moved.

As explained below, the movement of a motor 124 is performed at least based on a force previously measured by a load cell 122. This force is a direct consequence of the release of stresses accumulated in the component 130 and a load cell 122 can detect it accurately. Thus, driving motor 124 in response to and according to a force measured by a load cell 122 allows for an accurate and robust system of compensation of deformation.

The motor 124 may be any suitable motor for this purpose, i.e. any motor 124 that enables the automatization of the movement of the clamps 121 by driving a shaft of the motor 124. For instance, the motor 124 may be a stepper motor, or servomotor having an encoder or resolver.

In some examples, a clamping device 120 may also include reduction gearing (not shown) attached to the motor 124. This allows to reduce the speed but increase the torque of the output shaft of the motor 124 to the actuator (e.g. spindle) and thus to move heavier weights. The speed reducer may be a gearbox, e.g. a planetary gearbox, attached to the servo motor 124 and the spindle 123. In some examples, the speed reducer may be integrated into the servo motor 124.

In some other examples, a clamping device 120 also comprises a linear encoder 125 connected to the clamp 121 of the clamping device 120. The linear encoder 125 is configured to measure the absolute position of the corresponding clamp 121. That is to say, the absolute position of the clamp 121 can be obtained independently from the motor. The fact that the clamping device 120 comprises several components and each component may have its own inherent faults or imperfections that can cause that the position measurements obtained from the servo motor data are not as precise as desired. The linear encoder 125 enables to have more accurate and robust measures of position.

In some examples, a clamping device 120 comprises a position sensor (not shown) configured to determine an initial reference position for the one or more clamping devices 120. This allows to place the clamping device 120 in an initial known position which serves as a reference for subsequent movements of the clamping device 120.

Any kind of position sensor may be used to determine this initial reference position. However, for improved accuracy, a magnetic position sensor may be used. In general, a magnetic sensor is more accurate than an inductive sensor. Also, in general magnetic and inductive sensors are more robust that contact and optic sensors.

The previous examples may be combined, e.g. a clamping device 120 may comprise a gearbox and a linear encoder 125.

FIG. 3 schematically illustrates connections and communication channels between a clamping device 120 and a processing and control system 310 according to an example. The processing and control system 310 is in charge of receiving and collecting data from the one or more clamping devices 120, processing the received data and controlling the actions, e.g. movements, of the one or more clamping devices 120. In general, the processing and control system 310 collects data from and controls all the clamping devices 120 of the system 100. The processing and control system 310 may be an industrial computer such as a programmable logic controller (PLC).

For instance, the processing and control system 310 is configured to collect signals from a load cell 122 and to send signals based on the detected loads to a servo motor 124 to compensate for deformation due to a heat treatment performed to a component 130. Terms "data" and "signals" may be used interchangeably herein. Also, the terms "sensing", "collecting", "measuring" and "detecting" may be used interchangeably throughout this disclosure.

The processing and control system 310 may comprise three subsystems: a subsystem 311 that controls the input signals, a subsystem 312 that controls the motors 124, i.e. the output signals, and a subsystem 313 which comprises a central processing unit (CPU).

Subsystem 311 receives data from the one or more clamping devices 120. For instance, subsystem 311 collects signals from the load cells. A signal from a load cell 122 may be a force that a portion of the component 130 is being subjected to due to the deformation caused by a heating process on the component 130 which is measured by the load cell 122. In some examples, subsystem 311 further collects signals 122 from the linear encoder 125. A signal from a linear encoder 125 may be an absolute position of the clamp 121 which is measured by the linear encoder 125. As shown in FIG. 3, in some other examples, the subsystem 311 collects signals from the motor 124. Signals from a motor 124 may e.g. be the current of the servo motor 124 and the position of the motor 124, e.g. an angular position given by an encoder of the motor 124. Still in some other examples, the subsystem 311 collects signals from a position sensor configured to determine a reference initial position for the one or more clamping devices 120. All of these signals or some of these signals may be detected by subsystem 311.

Subsystem 312 transmits a signal to one or more of the servo motors 124 such that the motors 124 start to operate and they vertically move a corresponding clamp 121 to compensate for released stresses of the component 130. The signal transmitted by subsystem 312 may e.g. be an angular position that a motor 124 has to achieve or in general any signal that enables the motor 124 to move such that the corresponding clamp 121 is moved to a desired position. The signal transmitted by subsystem 312 may be generated at least in response to and according to collected data from the load cells 122.

In some cases, a control signal may also include an adaptation of the orientation of the motor such that the clamp may be driven in a different direction in order to compensate for a deformation that is measured.

Subsystem 313 is in charge of processing data, e.g. measured from load cells 122, in order to obtain output signals. Subsystem 313 may be also in charge of communications. For example, subsystem 313 may receive and/or transmit signals from one or more external devices. External devices may include another processing and control system 310, e.g. a processing and control system 310 that controls the heating process being performed on the component 130 and an external computer.

The processing and control system 310 may also comprise a memory (not shown). The memory generally stores instructions to be performed on the collected input data which allow to obtain output data that e.g. drives the servo motor 124. The memory may also store data, such as input and/or output signals.

Determining a suitable position during a treatment may be based on an analysis of the deformation, the geometry of the component, and the treatment that is being carried out (e.g. including a remainder of the treatment that is still to be carried out). In some examples, a machine learning process may be employed for training the processing and control system. After a suitable training phase, a machine learning algorithm may adapt the position of the clamps such that the resulting geometry of the component is as desired.

Figure 4:
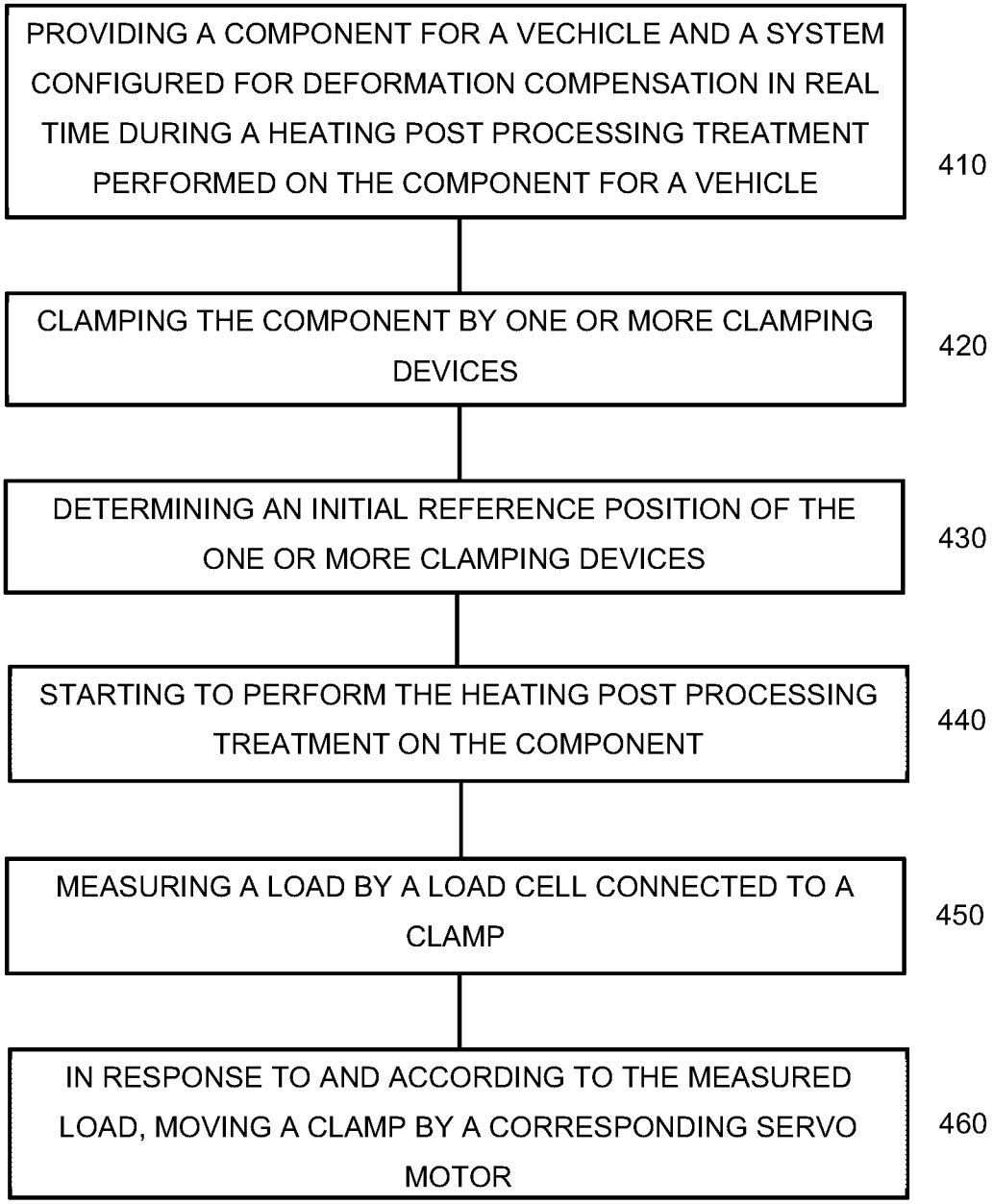
FIG. 4 illustrates a flow chart of a method for deformation compensation in real time during a heat treatment performed on a component for a vehicle.

FIG. 4 illustrates a flow chart of a method 400 for deformation compensation in real time during a heat treatment performed on a component for a vehicle.

The method 400 includes providing at block 410 a component for a vehicle 130 and a system configured for deformation compensation in real time during a heat treatment performed on the component for a vehicle as disclosed herein, for instance in any of FIGS. 1-3.

The component 130 may be any formed component for a vehicle. For instance, the component 130 may be any of a bumper, a pillar (e.g. A-pillar, B-pillar, C-pillar), a side impact beam and a rocker panel.

The method further includes, at block 420, clamping the component 130 by the one or more clamping devices 120. Clamps 121 clamp the component 130. Clamping may include in some examples applying an initial deformation of the component resulting from the previous forming process.

With the component 130 clamped by the one or more clamping devices 120, the method 400 may further comprise determining at block 430 an initial reference position of the one or more clamping devices 120. As explained above, this initial position may become the reference for the subsequent movements of the one or more clamping devices 120.

Once the component 130 is clamped by the one or more clamping devices 120 and an initial reference position of the one or more clamping devices 120 may be known, the method 400 further comprises starting at block 440 the heat treatment on the component 130.

The heat post processing treatment may include heating the whole component 130 or may include a local heat treatment, i.e., one or more regions of the component 130, but not the entire component 130, are heated. In other examples, the heat treatment may include an annealing of the entire component.

The heat treatment may change a microstructure of the component 130. For instance, a local heat treatment may comprise at least one of welding and creating a softzone. In some examples, the component 130 is subjected to welding. The component 130 may be welded in more than one region of the component 130 at partially or substantially overlapping times. Same or different welding techniques may be applied to different regions of the component 130. In some other examples, a softzone is being created in the component 130. More than one softzone may be created in the component 130, e.g. in different regions of the component 130. Two or more of the softzone regions may overlap, at least partially. It is also envisaged that more than one heat treatment is applied to the component 130. Two or more treatments may overlap in time, at least partially.

Heat treatments may include heating by laser, induction heating, heating by sending current through the component or any alternative heating method.

The method further comprises measuring 440 a load by a load cell 122 connected to a clamp 121 at block 450. In general, all the clamps 121 may have a connected load cell 122 and all the load cells 122 measure a corresponding load. However, other configurations in which not all clamps are movable and/or in which not all clamps have a connected load cell are possible as well.

The method 400 further includes, in response to and according to the measured load, moving 460 a clamp 121 e.g. by a corresponding servo motor 124.

To this end, the load measured by the load cell 122 is transmitted to the processing and control system 310. The processing and control system 310 detects the load measured by the load cell 122 and processes the load. Based on this load, the processing and control system 310 determines an action to be performed by a motor 124. The action in general is vertically moving a clamp 121. This action is indicated through signalling to the corresponding motor 124.

It may happen that the processing and control system 310 concludes that a clamp 121 does not need to be moved. In this case, the processing and control system 310 may not send any signal to a corresponding servo motor 124 and the servo motor 124 may not be activated. In some other examples, a signal indicating that the clamp 121 does not need to be moved may be sent to a corresponding servo motor 124.

The processing and control system 310 may collect data from any load cell 122 and may send signalling to any servo motor 124.

In some examples, a frequency of obtaining measurements may be between 1-1.000 Hz.

In general, steps 450 and 460 are executed more than once, i.e., the system 100 continuously receives measurements by the load cell(s) 122 and continuously determines and sends adjustment(s) of position(s) of clamp(s) 121 by the servo motor(s) 124 to compensate for the released stresses in the component 130.

This method 400 allows for a robust and accurate deformation compensation of released stresses accumulated in the component 130.

Optionally, the method 400 may further comprise mounting one or more clamping devices 120 to the supporting structure 110. I.e., in some examples, the supporting structure 110 may have one or more clamping devices 120 fixed in the supporting structure 110, e.g. if one or more clamping devices 120 cannot be moved along or over the supporting structure 110.

In some other examples, one or more clamping devices 120 may be positioned wherever in the supporting structure 110, e.g. if the one or more clamping devices 120 are movable along or over the supporting structure 110. For instance, a number and/or position and/or orientation of one or more clamping devices 120 may be chosen according to computational simulations.

Selecting a number of clamping devices 120 and/or positioning one or more clamping devices 120 according to computational simulations allows to tailor the compensation e.g. to the heat treatment that is applied to the component 130, to the component 130 and its features and/or to the region(s) of the component 130 where the treatment is applied. In other words, the method 400 is optimized.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

The invention claimed is:

1. A system for compensating a deformation in real time during a heat treatment performed on a component obtained by forming a steel blank, the system comprising:

a support;

a first clamping device arranged with the support, and comprising:

a first clamp configured to clamp a first region of the component, a first motor to drive the first clamp perpendicular to the first region of the component, and a first load cell connected to the first clamp, and configured to detect loads due to the heat treatment performed on the component;

a second clamping device arranged with the support and comprising:

a second clamp configured to clamp a second region of the component, a second motor to drive the second clamp perpendicular to the second region of the component, and a second load cell connected to the second clamp, and configured to detect loads due to the heat treatment performed on the component;

and the system further comprising:

a processing and control system configured to collect signals from the first and second load cells and to send first signals based on the detected loads to the first motor of the first clamping device, and to send second signals based on the detected loads to the second motor of the second clamping device, in order to compensate the deformation caused by the heat treatment due to a release of residual stresses accumulated in the component during the forming of the steel blank, wherein the second signals are different from the first signals.

2. The system of claim 1, wherein the first motor and/or the second motor is a servo motor having an encoder or resolver.

3. The system of claim 1, wherein first motor and/or the second motor is a stepper motor.

4. The system of claim 3, wherein the first motor is operatively connected with the first clamp through a linear drive mechanism.

5. The system according to claim 4, wherein the first motor is rotatably or pivotally mounted.

6. The system of claim 1, wherein the first clamping device further comprises:

a linear encoder connected to the first clamp, wherein the linear encoder is configured to measure the position of the first clamp and the processing and control system is further configured to collect signals from the linear encoder.

7. The system of claim 1, wherein the first and/or second clamping devices further comprise:

a position sensor configured to determine a reference initial position for the first and/or second clamping devices respectively.

8. The system of claim 4, wherein the linear drive mechanism includes a spindle.

* * * * *